United States Patent [19]

Tani

[11] 4,105,454

[45] Aug. 8, 1978

[54] SILVER HALIDE PHOTOGRAPHIC EMULSION SPECTRALLY SENSITIZED WITH MEROCYANINE DYES

[75] Inventor: Tadaaki Tani, Minami-ashigara

[73] Assignee: Fuji Photo Film Co., Ltd., Minami-ashigara, Japan

[21] Appl. No.: 765,023

[22] Filed: Feb. 2, 1977

[30] Foreign Application Priority Data

Feb. 5, 1976 [JP] Japan ..... 51 11730

[51] Int. Cl.[2] ..... G03C 1/08

[52] U.S. Cl. ..... 96/122

[58] Field of Search ..... 96/122, 139, 140

[56] References Cited

U.S. PATENT DOCUMENTS

| | | | |
|---|---|---|---|
| 2,882,159 | 4/1959 | Brooker et al. | 96/139 |
| 2,972,539 | 2/1961 | Jones | 96/122 |
| 3,615,631 | 10/1971 | Huckstadt et al. | 96/122 |
| 3,630,748 | 12/1971 | Gotze et al. | 96/139 |
| 3,718,476 | 2/1973 | Fumia et al. | 96/139 |
| 3,844,798 | 10/1974 | Ohlschlager et al. | 96/139 |

*Primary Examiner*—Mary F. Kelley

*Attorney, Agent, or Firm*—Sughrue, Rothwell, Mion, Zinn and MacPeak

[57] ABSTRACT

A silver halide photographic emulsion containing a combination of at least one merocyanine dye free of acidic groups and a benzotriazole compound which can produce a slightly soluble silver salt by reaction with silver ion, where the solubility product of the resulting silver salt is smaller than that of silver chloride, in effective supersensitizing amounts which exhibits reduced fog and a markedly increased spectral sensitivity.

10 Claims, No Drawings

SILVER HALIDE PHOTOGRAPHIC EMULSION SPECTRALLY SENSITIZED WITH MEROCYANINE DYES

BACKGROUND OF THE INVENTION

1. Field of the Invention

The present invention relates to silver halide photographic emulsions which are spectrally sensitized and, more particularly, to silver halide photographic emulsions containing merocyanine dyes which have improved spectral sensitization.

2. Description of the Prior Art

Various classes of dyes are known to be effective for use with the intention of spectrally sensitizing silver halide photographic emulsions. Of such classes, cyanine dyes and merocyanine dyes are predominantly employed. In particular, when the combination of two or more dyes, or that of a certain sensitizing dye and a certain compound which itself exhibits no sensitizing action or an extremely poor sensitizing action can exhibit a greater sensitization than the sum of the sensitivity achieved using each compound separately, such an action is known as supersensitization.

Various compounds which give rise to supersensitization when used in combination with merocyanine dyes are known. For instance, examples of such are disclosed in U.S. Pat. Nos. 3,480,434, 3,672,897, 3,703,377 and so on. However, these dyes give rise to a supersensitization in an efficient manner only with merocyanine dyes and the spectral sensitivity is restricted and limited to a particular wavelength region. Accordingly, the use of those dyes described above is limited to special cases. Therefore, discovery of supersensitization techniques which are applicable to combinations of a wide variety of merocyanine dyes and emulsions have been desired.

Thus far benzotriazole compounds are known as an anti-foggant, and are used with the intention of reducing fog. Moreover, it is well known that benzotriazole compounds frequently decrease photographic sensitivity. (For example, such desensitization action is described in Thomas R. Tomson, "Action of Organic Stabilizers on a Photographic Emulsion", *Photographic Science and Engineering,* Vol. 3, page 272, (1959) and in M.R.V. Sahyun, "Interaction of Benzotriazole with Development and Fog Centers", *Photographic Science and Engineering,* Vol. 15, page 48, (1971).) On the other hand, recently in Japanese Patent Application 7309/75 (corresponding to U.S. Patent Application Ser. No. 649,000, filed on Jan. 14, 1976) the fact that the photographic sensitivity of silver halide emulsions containing carbocyanine or dicarbocyanine dyes was markedly increased by the addition of halogenated benzotriazole compounds was disclosed.

Contrary to expectations, it has now been found out that the efficiency of spectral sensitization in silver halide emulsions containing, in particular, merocyanine dyes, free of acidic groups, is remarkably increased by the addition of benzotriazole compounds.

SUMMARY OF THE INVENTION

Therefore, an object of the present invention is to provide silver halide photographic emulsions which exhibit reduced fog and are rendered highly sensitive by spectral sensitization.

More specifically, an object of the present invention is to provide silver halide photographic emulsions wherein the spectral sensitization attributable to merocyanine dyes free of acidic groups is intensified with compounds which, by themselves, hardly cause fog and do not exert any spectral sensitization action on silver halide photographic emulsions.

The above-described object is attained with a silver halide photographic emulsion containing in supersensitizing amounts a combination of (1) at least one merocyanine dye free of acidic groups, and (2) a benzotriazole compound which can produce a slightly soluble silver salt by reaction with silver ion, wherein the solubility product of the resulting silver salt is smaller than that of silver chloride.

DETAILED DESCRIPTION OF THE INVENTION

Methods of synthesis, the photographic characteristics and the use of the above-described merocyanine dyes have long been known, for example, as described in F. M. Harmer, *The Cyanine Dyes and Related Compounds* (*The Chemistry of Heterocyclic Compounds*), Vol. 18, (1964) and C. E. K. Mees & T. H. James, *The Theory of the Photographic Process,* 3rd Edition, Chapters 11 and 12, Macmillan Co., New York, (1966).

The merocyanine dyes employed in the present invention must be free of acidic groups, i.e., they must not contain any acidic groups, such as sulfo groups and the salts thereof, and carboxyl groups and the salts thereof.

The merocyanine dyes employed in the present invention may be represented by the following general formula (I) (which represents an extreme in the structural formula thereof, and accordingly the real dye consists of some sort of resonance hybrid between other extremes):

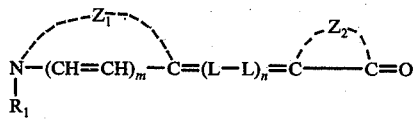

(I)

In the above general formula (I), m represents an integer 0 or 1; n represents an integer from 0 to 2.

$R_1$ represents an aliphatic group (including both saturated and unsaturated aliphatic groups) such as unsubstituted alkyl groups preferably containing from 1 to 8 carbon atoms, including methyl, ethyl, n-propyl, hexyl, etc.; substituted alkyl groups in which the alkyl moiety thereof contains preferably from 1 to 4 carbon atoms, including a vinylmethyl group, aralkyl groups (e.g., benzyl, phenethyl, etc.), hydroxyalkyl groups (e.g., 2-hydroxyethyl, 3-hydroxypropyl, 4-hydroxybutyl, etc.), acetoxyalkyl groups (e.g., 2-acetoxyethyl, 3-acetoxypropyl, etc.) and alkoxyalkyl groups (e.g., 2-methoxyethyl, 4-methoxybutyl, etc.), or aryl groups (e.g., phenyl, etc.).

$Z_1$ represents the non-metallic atoms necessary to complete a 5- or 6-membered nitrogen-containing heterocyclic ring, wherein the non-metallic atoms can include carbon, nitrogen, oxygen, sulfur and selenium atoms, and which may be substituted with one or more substituents, such as alkyl groups, preferably containing from 1 to 4 carbon atoms (e.g., methyl, ethyl, etc.), monoaryl groups (e.g., phenyl, etc.), halogen atoms, alkoxy groups, preferably containing from 1 to 4 carbon atoms (e.g., methoxy, ethoxy, etc.), monoaralkyl groups (e.g., benzyl, phenethyl, etc.), a trifluoromethyl group, a hydroxy group, alkoxycarbonyl groups (the alkyl moiety of which preferably contains from 1 to 4 carbon atoms, e.g., methoxycarbonyl, ethoxycarbonyl, etc.) or a cyano group, or which may contain saturated or unsaturated aliphatic hydrocarbon residues which may be taken together to complete a condensed ring having, for example, 6 carbon atoms.

Specific examples of these heterocyclic rings include thiazole nuclei (e.g., thiazole, 4-methylthiazole, 4-phenylthiazole, 4,5-dimethylthiazole, 4,5-diphenylthiazole, etc.); benzothiazole nuclei (e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, etc.); naphthothiazole nuclei (e.g., naphtho[2,1-d]thiazole, naphtho[1,2-d]-thiazole, naphtho[2,3-d]thiazole, 5-methoxynaphtho[1,2-d]-thiazole, 8-methoxynaphtho[2,1-d]thiazole, 5-methoxy[2,3-d]-thiazole, etc.); thiazoline nuclei (e.g., thiazoline, 4-methylthiazoline, etc.); oxazole nuclei (e.g., oxazole, 4-methyloxazole, 4-ethyloxazole, etc.); benzoxazole nuclei (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluoromethylbenzoxazole, 5-hydroxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, etc.); naphthoxazole nuclei (e.g., naphtho[2,1-d]oxazole, naphtho[1,2-d]oxazole, naphtho[2,3-d]oxazole, etc.); oxazoline nuclei (e.g., 4,4-dimethyloxazoline, etc.); selenazole nuclei (e.g., 4-methylsenenazole, 4-phenylselenazole, etc.); benzoselenazole nuclei (e.g., benzoselenazole, 5-chlorobenzoselenazole, 5-methoxybenzoselenazole, 5-methylbenzoselenazole, 5-hydroxybenzoselenazole, etc.); naphthoselenazole nuclei (e.g., naphtho-[2,1-d]selenazole, naphtho[1,2-d]selenazole, etc.); 3,3-dialkylindolenine nuclei (e.g., 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimethyl-5-chloroindolenine, etc.); imidazole nuclei (e.g., those which have, at the 1-position, substituents, such as alkyl, allyl, aryl, acetoxy, hydroxyalkyl or the like, including 1-methylimidazole, 1-ethylimidazole, 1-methyl-4-phenylimidazole, 1-ethyl-4-phenylimidazole, etc.); benzimidazole nuclei (e.g., 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-ethyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-methyl-5-trifluoromethylbenzimidazole, 1-ethyl-5-trifluoromethylbenzimidazole, 1-ethylnaphtho[1,2-d]imidazole, 1-allyl-5,6-dichlorobenzimidazole, 1-allyl-5-chlorobenzimidazole, 1-phenylimidazole, 1-phenylbenzimidazole, 1-phenyl-5-chlorobenzimidazole, 1-phenyl-5,6-dichlorobenzimidazole, 1-phenyl-5-methoxybenzimidazole, 1-phenyl-5-cyanobenzimidazole, etc.); naphthoimidazole nuclei (e.g., 1-phenylnaphtho[1,2-d]imidazole, 1-ethylnaphtho[1,2-d]-imidazole, etc.); tetrazole nuclei (e.g., 1,3-dimethyltetrazole, 1-methyl-3-ethyltetrazole, etc.); pyridine nuclei (e.g., pyridine, 5-methyl-2-pyridine, 3-methyl-4-pyridine, etc.); quinoline nuclei (e.g., quinoline, 3-methyl-2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, 6-ethoxy-4-quinoline, 8-chloro-4-quinoline, 8-fluoro-4-quinoline, 8-methyl-4-quinoline, 8-methoxy-4-quinoline, isoquinoline, 3,4-dihydro-1-isoquinoline, etc.) and so on.

$Z_2$ represents the non-metallic atoms necessary to complete a 5- or 6-membered nitrogen-containing heterocyclic ring, wherein the non-metallic atoms can include nitrogen, oxygen, sulfur or selenium, in addition to carbon, and which may contain one or more substituents such as alkyl groups, preferably containing 1 to 4 carbon atoms (e.g., methyl, ethyl, etc.), aryl groups (e.g., phenyl, p-chlorophenyl, etc.), alkoxy groups, preferably containing from 1 to 4 carbon atoms (e.g., methoxy, ethoxy, etc.), monoaralkyl groups (e.g., benzyl, phenethyl, etc.), and like groups, or which may contain saturated or unsaturated aliphatic hydrocarbon residues which may be taken together to complete a condensed ring having, for example, 6 carbon atoms. Specific examples of these heterocyclic nuclei include isooxazolone, thiobarbituric acid, barbituric acid, 1,3-indanedione, 2-pyrazoline-5-one, 2-thiooxazolidinedione, oxyindole, rhodanine, 2-thiohydantoin and so on.

L represents a methine linkage (e.g., —CH=, —$CR_0$=, wherein $R_0$ represents a hydrogen atom, an alkyl group (e.g., methyl, ethyl, n-propyl, isopropyl, n-butyl, isobutyl, etc.), a substituted alkyl group (e.g., β-hydroxyethyl, γ-hydroxypropyl, β-acetoxyalkyl, etc.), an aralkyl group (e.g., benzyl, etc.), an aryl group (e.g., phenyl, etc.), or a cycloalkyl group (e.g., cyclohexyl, etc.)).

Examples of highly useful merocyanine dyes in the present invention include the following classes of dyes having the respective general formulae (I-A) to (I-F):

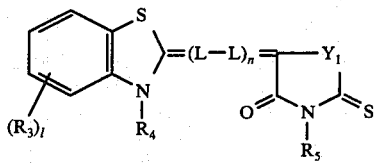

(I-A)

wherein $R_4$ and $R_5$, which may be the same or different, each has the same meaning as $R_1$ in the above-described general formula (I); $R_3$ represents an alkyl group, preferably containing from 1 to 4 carbon atoms (e.g., methyl, ethyl, etc.), a monoaryl group (e.g., phenyl, etc.), a halogen atom (e.g., chlorine, bromine, etc.), an alkoxy group, preferably containing from 1 to 4 carbon atoms (e.g., methoxy, ethoxy, etc.), a monoaralkyl group (e.g., benzyl, phenethyl, etc.), a trifluoromethyl group, a hydroxy group, an alkoxycarbonyl group in which the alkyl moiety contains preferably from 1 to 4 carbon atoms (e.g., methoxycarbonyl, ethoxycarbonyl, etc.), a cyano group, or a saturated or an unsaturated aliphatic hydrocarbon residue which may also complete a condensed ring having 6 carbon atoms; $Y_1$ represents a sulfur atom or an oxygen atom; l represents an integer from 0 to 4; n represents an integer from 0 to 2; and L has the same meaning as in the general formula (I):

(I-B)

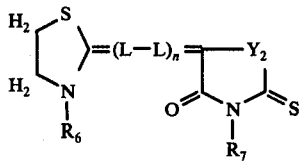

wherein $R_6$ and $R_7$, which may be the same or different, each has the same meaning as $R_1$ in the general formula (I) described above; $Y_2$ represents a sulfur atom or an oxygen atom; L has the same meaning as in the general formula (I); and n represents an integer from 0 to 2;

(I-C)

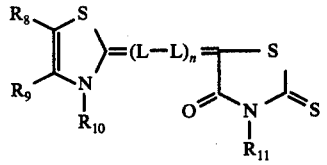

wherein $R_{10}$ and $R_{11}$, which may be the same or different, each has the same meaning as $R_1$ in the general formula (I) described above; $R_8$ and $R_9$, which may be the same or different, each represents an alkyl group (e.g., methyl, etc.) or an aryl group (e.g., phenyl, etc.); and n and L each has the same meaning as n and L, respectively, in the general formula (I-A);

(I-D)

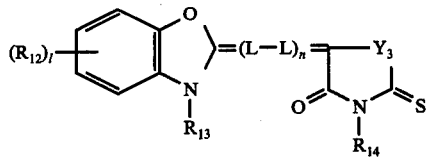

wherein $R_{13}$ and $R_{14}$, which may be the same or different, each has the same meaning as $R_1$ in the general formula (I); $Y_3$ represents a sulfur atom or an $$-\underset{|}{N}-T \text{ group,}$$

wherein T has the same meaning as $R_1$ in the general formula (I); l and n each has the same meaning as l and n, respectively, in the general formula (I-A); L has the same meaning as in the general formula (I); and $R_{12}$ represents an alkyl group, preferably containing from 1 to 4 carbon atoms (e.g., methyl, etc.), a monoaryl group (e.g., phenyl, etc.), a halogen atom (e.g., chlorine, bromine, fluorine, etc.), a hydroxy group, or an alkoxy group, preferably containing from 1 to 4 carbon atoms (e.g., methoxy, ethoxy, etc.);

(I-E)

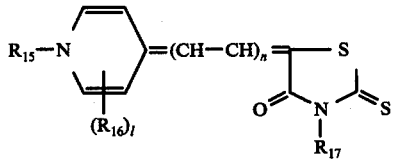

wherein $R_{15}$ and $R_{17}$, which may be the same or different, each has the same meaning as $R_1$ in the general formula (I); $R_{16}$ represents a hydrogen atom or a lower alkyl group, preferably containing from 1 to 4 carbon atoms (e.g., methyl, etc.); and l and n each has the same meaning as l and n, respectively, in the general formula (I-A); and (I-F)

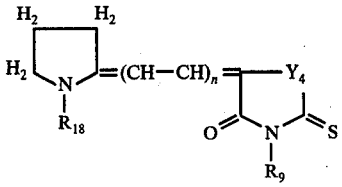

wherein $R_{18}$ and $R_{19}$, which may be the same or different, each has the same meaning as $R_1$ in the general formula (I); $Y_4$ represents an oxygen atom, a sulfur atom or an $$-\underset{|}{N}-T \text{ group,}$$

wherein T has the same meaning as $R_1$ described above; and n has the same meaning as in the general formula (I).

Each of these merocyanine dyes is used in the amount sufficient to effectively increase the sensitivity of a silver halide emulsion in the wavelength region for which spectral sensitization is desired. The quantity of the dye can be varied over a wide range depending on the properties of the emulsion used and so on, e.g., a suitable range preferably is from about $10^{-6}$ mol to $10^{-2}$ mol, and particularly from about $10^{-5}$ mol to $10^{-3}$ mol per mol of silver halide.

Each of the sensitizing dyes can be added to an emulsion having techniques well known in this art.

The sensitizing dye can be dispersed directly into an emulsion, or added to an emulsion as a solution prepared by dissolving the dye in an appropriate solvent, for example, a water-miscible solvent such as pyridine, methyl alcohol, ethyl alcohol, methyl Cellosolve, acetone, mixtures thereof or the like, or water alone. Dissolution of the sensitizing dye can be achieved by using ultrasonic vibration. In addition, various methods suitable for dissolving or dispensing the sensitizing dye into an emulsion can be used, for example, the method of adding a dispersion of a material to an emulsion, which was prepared by dispersing a solution of the dye in a volatile organic solvent into a hydrophilic colloid, as disclosed in U.S. Pat. No. 3,469,987; another method of adding a dispersion of a material which was prepared by dispersing a water-insoluble dye into a water-insoluble solvent without dissolution in an emulsion, as disclosed in Japanese Patent Publication 24185/71; and a further method of adding a dispersion of a material which was prepared using an acid dissolution-dispersion technique to an emulsion. Moreover, suitable methods for adding the dye to an emulsion include those methods as disclosed in U.S. Pat. Nos. 2,912,345, 3,342,605, 2,996,287, 3,425,835 and so on.

The benzotriazole compounds which can be employed in the present invention are those which can produce slightly soluble silver salts by reaction with silver ions, where the solubility product constant of the resulting silver salt is smaller than that of silver chloride (e.g., $1.14 \times 10^{-10}$ (at 20° C)). More specifically, silver salts of benzotriazole compounds useful in the present invention are more difficult to dissolve into water than silver chloride.

Benzotriazole compounds which can be used to advantage in the present invention can be represented by the following general formula (II):

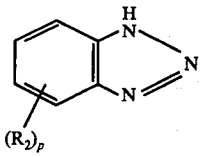

(II)

wherein p represents an integer from 0 to 4; and $R_2$ represents a halogen atom (such as chlorine, bromine and iodine), an aliphatic residue (which may be a saturated or unsaturated aliphatic residue), for example, an unsubstituted alkyl group, preferably containing from 1 to 8 carbon atoms, such as methyl, ethyl, n-propyl, hexyl, etc., and a substituted alkyl group in which the alkyl moiety thereof contains preferably from 1 to 4 carbon atoms, such as a vinylmethyl group, an aralkyl group (e.g., benzyl, phenethyl, etc.), a hydroxyalkyl group (e.g., 2-hydroxyethyl, 3-hydroxypropyl, 4-hydroxybutyl, etc.), an acetoxyalkyl group (e.g., 2-acetoxyethyl, 3-acetoxypropyl, etc.), an alkoxyalkyl group (e.g., 2-methoxyethyl, 4-methoxybutyl, etc.) or the like, or an aryl group (e.g., phenyl, etc.), and more particularly $R_2$ represents a halogen atom such as chlorine or iodine, or an alkyl group, preferably containing from 1 to 3 carbon atoms, such as methyl, ethyl or propyl.

Benzotriazole compounds, other than those which have the above-described general formula (II), for example, benzotriazoles substituted with carboxy groups, benzotriazoles substituted with sulfo groups and benzotriazoles substituted with nitro groups, may be also employed in combinations with merocyanine dyes free of acidic groups. However, the combinations of benzotriazole compounds substituted with halogen atoms or alkyl groups containing from 1 to 3 carbon atoms and merocyanine dyes free of acidic groups are of greater advantage for use in the present invention than the above-described benzotriazole compounds.

Specific examples of benzotriazole compounds which can be used to advantage in the present invention are illustrated below:

Dye (II-1)

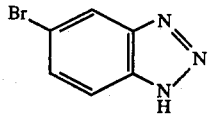

Dye (II-2)

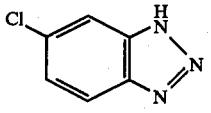

Dye (II-3)

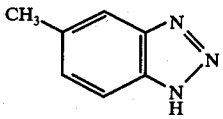

The amount of the benzotriazole compound added to an emulsion can be that sufficient to effectively increase the sensitivity. This concentration can be varied over a wide range depending on the conditions under which the emulsion was produced. The benzotriazole compound is incorporated into the emulsion in an amount preferably ranging from about 0.00001 mol to 0.1 mol, and particularly, from 0.0005 mol to 0.05 mol, per mol of silver halide. The molar ratio of the benzotriazole compound to the merocyanine dye which can be employed practically in the present invention ranges preferably from about 1:1 to about 300:1, more preferably from 2:1 to 100:1, and as a guide 1:1 to 100:1, but the molar ratio which can be used is not to be interpreted as being limited to these specific ratios.

The photographic emulsion subjected to sensitization in accordance with the present invention may additionally contain sensitizing dyes other than the dyes having the general formula (I) or essentially colorless compounds which are known to exhibit a supersensitization within such an amount that they do not deleteriously affect the effect achieved with the supersensitizing combination achieved in the present invention. For example, the emulsion may contain compounds containing a pyrimidinyl amino group or a triazinyl amino group, as disclosed in U.S. Pat. Nos. 2,933,390, 3,511,664, 3,615,613, 3,615,632, 3,615,641 and so on; aromatic organic acid-formaldehyde condensation products as disclosed in British Patent No. 1,137,580; azaindenes; or cadmium salts.

A multilayer photographic material can be produced using the light-sensitive material containing a photographic emulsion sensitized according to the present invention with other emulsion layers sensitized in different ways from that of the present invention or with unsensitized emulsion layers. Various arrangements of these emulsion layers in the multilayer photographic material can be optionally selected.

The present invention is further described below with reference to various embodiments thereof.

The silver halide grains used in the light-sensitive emulsions can be produced by the reaction of a water-soluble silver halide and a water-soluble halide in a hydrophilic colloidal aqueous solution exhibiting a protective colloidal action, and the resulting emulsion is chemically ripened after addition of chemical sensitizers. Then, the above-described merocyanine dye can be added thereto, while the benzotriazole compound can be added thereto subsequently. However, the time of addition of the benzotriazole compound to the emulsion can be prior to the conclusion of a chemical ripening process.

Examples of suitable silver halides which may be used in the present invention include silver chloride, silver bromide, silver iodide or mixed silver halides thereof (solid solutions) in various mixing ratios. A preferred silver halide is silver chlorobromide, silver iodobromide or chloroiodobromide, preferably having an iodide content of not more than about 10 mol%. Particularly, silver halides having an iodide content of not more than 6 mol% are more preferred.

The average grain size of the silver halide grains incorporated in the photographic emulsion (as measured by a number average method, wherein the grain size may be taken to be equal to the diameter in case of spherical or sphere-like grains, while equal to the length of a side in case of cubic grains) is not limited, but preferably is 4 microns or less, and more particularly from about 0.04 micron to about 2 microns.

The distribution of the silver halide grain size can be either narrow or broad.

The silver halide grains incorporated in the photographic emulsion may have a regular crystal structure such as a cube or an octahedron, an irregular crystal structure such as a sphere or a plate, or may be a mixed form of these crystal structures. Moreover, silver halide grains having different crystal structures may be incorporated together in the photographic emulsion.

The grains of silver halide may be composed of different phases between the inner core and the outer shell, or may comprise one homogeneous phase. In addition, the grains may be of a type in which a latent image is formed either mostly on the surface of the grains, or predominantly inside the grains.

The silver halide photographic emulsions which can be employed in the present invention can be produced by using methods as described in P. Glafkides, *Chimie et Physique Photographiques,* Paul Montel, Paris (1967), G. F. Duffin, *Photographic Emulsion Chemistry,* The Focal Press (1966) and V. L. Zelikman, et al., *Making and Coating Photographic Emulsions,* The Focal Press (1964). More specifically, any methods which can provide acid type emulsions, neutral type emulsions or ammonia type emulsions can be used in the present invention. Furthermore, water-soluble silver salts and water-soluble halides may be allowed to react using any mixing methods, for example, a single jet method, a double jet method, a combination of these methods, and so on.

Silver halide grains of the kind which are formed under conditions of excess silver ions (the so-called reverse mixing method) can be also employed.

Examples of double jet methods which can be used include a method in which the pAg value is held constant throughout the process of forming the silver halide in a solution, that is to say, the so-called controlled double jet method can be also used.

According to this method, silver halide emulsions containing silver halide grains which have a regular crystal structure and a grain size close to a uniform value can be produced.

Two or more kinds of silver halide emulsions, each of which was prepared in different ways, may be mixed on use.

During formation of the silver halide grains, or during physical ripening, cadmium salts, zinc salts, lead salts, thallium salts, iridium salts or the complex salts thereof, rhodium salts or the complex salts thereof, iron salts or the complex salts thereof, and so on may be present.

Gelatin can be employed to advantage as a binder or a protective colloid for photographic emulsions, while various hydrophilic colloids, other than gelatin, can be also employed.

Specific examples of such colloids include proteins such as gelatin derivatives, graft polymers prepared from gelatin and other high polymer compounds, albumin, casein, etc.; saccharide derivatives such as cellulose derivatives including hydroxyethyl cellulose, carboxymethyl cellulose, cellulose sulfate and the like, sodium alginate, starch derivatives, etc.; and a wide variety of synthetic hydrophilic polymers such as polyvinyl alcohol, polyvinyl alcohols in which a part of the alcohol groups are converted to acetals, poly-N-vinylpyrrolidone, polyacrylic acid, polymethacrylic acid, polyacrylamide, polyvinyl imidazole, polyvinyl pyrazole and like homopolymers, or copolymers of the monomers which compose the above-described homopolymers.

As a gelatin component, not only lime-processed gelatin, but also acid-processed gelatin may be employed. Also, hydrolysis products of gelatin and enzymic decomposition products of gelatin can be used. Examples of gelatin derivatives which can be employed as a gelatin component include reaction products of gelatin and a wide variety of compounds such as acid halides, acid anhydrides, isocyanates, bromoacetic acids, alkane sultones, vinyl sulfonamides, maleinimide compounds, polyalkylene oxides, epoxy compounds and so on.

Water-soluble salts are usually removed from the emulsions after the production of the silver halide grains or the physical ripening process. For this purpose, a well-known noodle washing method wherein gelatin receives a gelation treatment, or a flocculation method using inorganic salts containing a polyvalent anion (e.g., sodium sulfate), anionic surface active agents, anionic polymers (e.g., polystyrene sulfonic acid), or gelatin derivatives (e.g., aliphatic acylated gelatins, aromatic acylated gelatins, aromatic carbamoylated gelatins and so on) may be employed. The process of removing water-soluble salts from emulsions may be omitted, if desired.

Chemically sensitized silver halide emulsions are usually employed as the silver halide emulsions, although chemically unsensitized emulsions (the so-called primitive emulsions) can be also used. Conventionally employed chemical sensitization techniques which can be used for silver halide emulsions include those which are described in Glafkides, supra and Zelikman, supra, respectively, and H. Frieser, *Gründlagen der Photographishen Prozesse mit Silberhalogeniden,* Akademishe Verlagesgesellschaft (1968).

More specifically, sulfur sensitization techniques using compounds containing sulfur reactive with silver ions and active gelatins, reduction sensitization techniques using reductive compounds, and noble metal sensitization techniques using gold and other noble metals can be employed individually or as combinations thereof. Examples of sulfur sensitizers include thiosulfates, thioureas, thiazoles, rhodanines and the like compounds. Specific examples of these compounds are described in U.S. Pat. Nos. 1,574,944, 2,410,689, 2,278,947, 2,728,668 and 3,656,955. Examples of reduction sensitizers which can be used include stannous salts, amines, hydrazine derivatives, formamine disulfinic acids, silane compounds and so on. Specific examples of these compounds are described in U.S. Pat. Nos. 2,487,850, 2,419,974, 2,518,698, 2,983,609, 2,983,610 and 2,694,637. Complex salts of Group VIII metals, such as platinum, iridium, palladium, etc., as well as gold complex salts, can be employed for noble metal sensitization. Specific examples of such sensitization techniques are disclosed in U.S. Pat. Nos. 2,399,083 and 2,448,060, British Patent No. 618,061, and so on.

Surface active agents can be added to the photographic emulsions of the present invention, either individually or as a mixture thereof. The surface active agents are generally employed as a coating aid, but sometimes they are used for other purposes, for example, emulsifying dispersion, sensitization, improvement in the photographic characteristics, prevention of the generation of static charges and adhesion, and so on.

Examples of suitable surface active agents include natural surface active agents such as saponin; nonionic surface active agents of the alkylene oxide type, glycerin type, glycidol type and so on; cationic surface active agents, such as higher alkylamines, quaternary ammonium salts, heterocyclic compounds, such as pyridine and other heterocyclics, phosphoniums, sulfoniums and so on; anionic surface active agents containing acid groups, such as a carboxylic acid group, a sulfonic acid group, a phosphoric acid group, a sulfate group, a phosphate group, etc.; and ampholytic surface active agents of the amino acid type, the aminosulfonic acid type, the sulfates or phosphates of aminoalcohols and so on.

The hardening of the emulsions can be carried out in a conventional manner. Preferred hardeners include, for example, aldehyde compounds, such as formaldehyde and glutaraldehyde; ketone compounds, such as diacetyl and cyclopentandione; active halogen-containing compounds, such as bis(2-chloroethylurea), 2-hydroxy-4,6-dichloro-1,3,5-thiazine, etc.; active olefin-containing compounds, such as divinylsulfone, 5-acetyl-1,3-diacryloyl-hexahydro-1,3,5-triazine, etc.; N-methylol compounds, such as N-hydroxymethylphthalimide, etc.; isocyanates; aziridines; acid derivatives; carbodiimide compounds; vinyl sulfonyl compounds, such as bis(vinylsulfonyl)methyl ether, etc.; isooxazolium compounds; isooxazole compounds; halocarboxyaldehydes, such as mucochloric acid; dioxane derivatives, such as dihydroxydioxane, dichlorodioxane, etc.; and inorganic hardeners, such as chrom alum, zirconium sulfate, etc. In addition, instead of the above-described compounds, precursers thereof, for example, addition products of an alkali metalbisulfite and an aldehyde, methylol derivatives of hydantoin, primary aliphatic nitroalcohols and so on may be employed.

The silver halide photographic emulsions which can be employed in the present invention can contain color image forming couplers, that is to say, compounds of the kind which can produce dyes by reacting with an oxidation product of an aromatic amine (usually primary amine) color developing agent, (which are abbreviated as couplers hereinafter). It is desirable for these couplers to be non-diffusable through the use of hydrophobic groups called ballast groups contained in the molecules. The coupler can be either a 4-equivalent or 2-equivalent coupler. Moreover, colored couplers for color correction, and development inhibiting compound-releasing type couplers (the so-called DIR couplers) can also be incorporated into the photographic emulsions of the present invention.

Conventionally used open-chain ketomethylene couplers can be employed as yellow couplers. Of these couplers, benzoyl acetanilide series and pivaloyl acetanilide series compounds are preferred. Specific examples of yellow couplers which can be used in the present invention include those which are described in U.S. Pat. Nos. 2,875,057, 2,895,826, 3,265,506, 3,253,924, 3,369,895, 3,408,194, 3,551,155, 3,582,322 and 3,725,072, German Patent Publication 1,547,868, and German Patent Applications (OLS) 2,057,941, 2,162,899, 2,213,461, 2,219,917, 2,261,361, 2,263,875 and so on.

Pyrazolone compounds, indazolone series compounds, cyanoacetyl compounds and so on can be employed as magenta couplers. Of these compounds, pyrazolone compounds are preferred. Specific examples of magenta couplers applicable to the present invention include those which are disclosed in U.S. Pat. Nos. 2,439,098, 2,600,788, 2,895,826, 2,983,608, 3,062,653, 3,214,437, 3,253,924, 3,311,476, 3,419,391, 3,519,429, 3,558,319, 3,582,322 and 3,615,506, British Patent No. 956,261, German Patent No. 1,810,464, German Patent Applications (OLS) 2,408,665, 2,418,959 and 2,424,467, Japanese Patent Publications 6031/65 and 2016/69, and so on.

Phenol derivatives, naphthol derivatives and the like can be employed as cyan couplers. Specific examples of these cyan couplers are described in U.S. Pat. Nos. 2,369,929, 2,434,272, 2,474,293, 2,706,684, 2,895,826, 3,034,892, 3,253,924, 3,311,476, 3,386,830, 3,458,315, 3,560,212, 3,583,971 and 3,591,383, British Patent No. 1,201,110, and so on.

Examples of colored couplers which can be incorporated into emulsions used in the present invention include those which are disclosed in Japanese Patent Publication 2016/69, U.S. Pat. Nos. 2,434,272, 3,476,560 and 3,476,564, German Patent Application (OLS) 2,418,959, Japanese Patent Publications 22335/63, 20591/66, 11304/67 and 32461/69, U.S. Pat. Nos. 2,521,908, 3,034,892 and 3,386,830, and so on.

Compounds of the kind which contain, as a releasing group on a coupling reaction, a residue which can form a development-inhibiting agent are employed as DIR couplers. Specific examples of the above-described compounds are described in U.S. Pat. Nos. 3,148,062, 3,227,554, 3,617,291, 3,622,328, 3,701,783, 3,770,436 and 3,790,384, German Patent Applications (OLS) 2,414,006, 2,417,914, 2,417,945, 2,454,301 and 2,454,329, British Patent No. 953,454, and so on.

Compounds which can release development inhibiting agents with development, other than DIR couplers, can be incorporated in the light-sensitive materials. For example, compounds as disclosed in U.S. Pat. No. 3,629,417 can be employed.

Two or more of the above-described couplers can be incorporated into the same layer, or the same compound can also be incorporated into two or more different layers to achieve the characteristics required for the photosensitive materials.

The couplers can be incorporated into emulsion layers using conventional techniques. For example, the method as disclosed in U.S. Pat. No. 2,322,027 can be employed herein. More specifically, couplers which have previously been dissolved in an organic solvent having a high boiling point of 180° C or above, such as phthalic acid alkyl esters (e.g., dibutyl phthalate, dioctyl phthalate, etc.), trimellitic acid esters (e.g., tri-t-octyltrimellitate, etc.), phosphoric acid esters (e.g., diphenyl phosphate, triphenyl phosphate, tricresyl phosphate, dioctylbutyl phosphate, etc.), citric acid esters (e.g., tributyl acetylcitrate, etc.), alkylamides (e.g., N,N-diethyllaurylamide, etc.) and so on, or an organic solvent having a low boiling point ranging from about 30° to 150° C, such as lower alkyl acetates (e.g., ethyl acetate, butyl acetate, etc.), propionic acid esters, sec-butyl alcohol, methyl isobutyl ketone, $\beta$-ethoxyethyl acetate, methyl Cellosolve acetate and so on, are dispersed into a hydrophilic colloid. A mixture of organic solvents having a high boiling point and a low boiling point, respectively, as described above, may be employed.

Couplers containing an acid group, such as a carboxylic acid group, a sulfonic acid group or the like can be incorporated into a hydrophilic colloid in the form of an alkaline solution thereof.

These couplers are generally added to an emulsion in an amount ranging from about $2 \times 10^{-3}$ mol to $5 \times 10^{-1}$ mol, and preferably from about $1 \times 10^{-2}$ mol to $5 \times 10^{-1}$ mol, per mol of silver contained in the emulsion.

Dispersions of water-insoluble or slightly water-soluble synthetic polymers can be incorporated into the photographic emulsions employed in the present invention with the intention of improving the dimensional stability of the emulsions. Examples of such polymers include homopolymers and copolymers containing, as a monomer unit, an alkyl(meth)acrylate, an alkoxyalkyl(meth)acrylate, a glycidyl(meth)acrylate, a (meth)acrylamide, a vinyl ester (e.g., vinyl acetate), acrylonitrile, an olefin or styrene individually and as a combination thereof, respectively, and copolymers containing, as a monomer unit, a combination of one of the above-described monomers and another monomer selected from the group consisting of acrylic acid, methacrylic acid, $\alpha,\beta$-unsaturated dicarboxylic acids, hydroxyalkyl(meth)acrylates, sulfoalkyl(meth)acrylates, styrene sulfonic acid and so on.

The photographic emulsions which can be employed in the present invention can contain a wide variety of compounds for purposes of preventing fogging or stabilizing the photographic functions during the production, storage or processing thereof. More specifically, compounds belonging to azoles or azines such as benzothiazoles, amino-, nitro- or halogen-substituted benzimidazoles, nitro- or amino-substituted indazoles, mercaptothiazoles, mercaptobenzothiazoles, mercaptobenzimidazoles, mercaptothiadiazoles, mercaptotriazoles, mercaptotetrazoles, mercaptopyrimidines, thioketo compounds, such as thiazolethione and so on; azaindenes, such as triazaindenes, tetraazaindenes, pentaazaindenes and the like; benzene sulfinic acid, benzene sulfinamide, benzene thiosulfonic acid, thioctic acid, phenazines, iodonium salts, iodates, aromatic polyols, such polymers as polyvinyl pyrrolidone, halogen-substituted divalent fatty acids, noble metal salts (e.g., gold, platinum, palladium and iridium compounds), heterocyclic ring-containing aminostilbene compounds and so on can be used individually or as combinations thereof.

Various kinds of chelating agents including, for example, dihydroxybenzoic acid, gallic acid, dimethylglyoxime, ethylenediamine tetraacetic acid and the like can be added to the emulsion in order to prevent fogging and desensitization caused by metal ions.

In order to increase the sensitivity and contrast, or accelerate the developing rate, for example, polyalkylene oxides or the ether, ester or amide derivatives thereof, thioether compounds, thiomorpholines, quaternary ammonium salt compounds, urethane derivatives, urea derivatives, imidazole derivatives, 3-pyrazolidones and so on can be added to the photographic emulsion of the present invention. Moreover, the photographic emulsions which can be employed in the present invention may contain dyes used for anti-irradiation effects, filter dyes, compounds which can absorb efficiently ultraviolet rays, fluorescent brightening agents, color fog-preventing agents, cationic polymers employable as a mordant and other additives commonly used in the art. Also, photographic light-sensitive materials consisting of the photographic colloid layers containing the above-described additives and the photographic emulsion layer produced in accordance with the present invention may be useful.

The finished emulsion of the present invention can be coated on a conventionally used flexible support, such as a plastic film, paper, cloth or the like, or a rigid support, such as glass, ceramics, metal or the like. Examples of flexible supports which can be used to advantage include films of semi-synthetic or synthetic polymers, such as cellulose nitrate, cellulose acetate, cellulose acetate butyrate, polystyrene, polyvinyl chloride, polyethylene terephthalate, polycarbonate and the like, and papers which are coated or laminated with baryta, and $\alpha$-olefin resin (e.g., polyethylene, polypropylene, an ethylene-butene copolymer, etc.), or like substances. Dyes or pigments can optionally be added to the support for the purpose of coloration. The support can be colored black in order to shield the emulsion from light. A suitable coating amount of silver halide can range from about 0.05 to about 5 mg/cm$^2$.

A subbing layer is generally provided on the support for the purpose of improving the adhesion of the support to the photographic emulsion layer. The surface of the support may be subjected to a corona discharge, an ultraviolet irradiation or a flame treatment before or after the subbing layer is coated thereon.

The present invention can be used in producing a wide variety of silver halide photographic light-sensitive materials. Specific examples of such light-sensitive materials include, for example, conventional color and black-and-white negative materials, conventional color and black-and-white reversal materials, color and black-and-white photographic printing papers, lithographic type light-sensitive materials, sensitive materials for recording X-rays indirectly, sensitive materials for microfilms, color and black-and-white negatives and positives employed for moving pictures, and color and black-and-white sensitive materials containing emulsions for the diffusion transfer process. However, sensitive materials to which the present invention can be applied are not intended to be construed as being limited to these examples listed above.

The photosensitive materials of the present invention can be exposed to obtain photographic images in a conventional manner. Light from various known light sources, such as natural light (sunlight), a tungsten lamp, a fluorescent lamp, a mercury lamp, a xenon arc lamp, a carbon arc lamp, a xenon flash lamp, a cathode ray tube display flying spot and so on can be employed as a light source. Exposure times commonly used when photographic pictures are taken with a camera ranging from 1/1,000 sec to 1 sec and exposure times shorter than 1/1,000 sec, for example, $1/10^4$ to $1/10^6$ second exposure using a xenon flash lamp or a cathode ray tube display, and an exposure time longer than 1 sec can be used for the photographic materials of the present invention. A color filter which can selectively absorb lights of certain wavelengths can be optionally employed for controlling the spectral distribution of the light source used. Moreover, the photographic sensitive materials of the present invention may be exposed to laser rays, or rays emitted from various kinds of fluorescent materials which are excited by irradiation of electron beams, X-rays, $\gamma$-rays, $\alpha$-rays or the like.

The present invention will now be illustrated in greater detail by reference to the following Examples. Unless otherwise indicated herein, all parts, percents, ratios and the like are by weight.

EXAMPLE 1

A photographic emulsion containing silver bromide grains which have a cubic structure and an average grain size of 1 micron was produced using a conventional double run method. More specifically, to a gelatin aqueous solution a water solution of silver nitrate and a water solution of potassium bromide were added simultaneously while stirring thoroughly in such a manner that the silver ion concentration in the gelatin solution was maintained constant. The resulting emulsion contained 0.38 mol of silver bromide and about 45 g of gelatin per liter thereof.

A 2 liter portion of the thus obtained emulsion was measured out, to which 70 ml of a 0.1% by weight aqueous solution of sodium thiosulfate (pentahydrate) was added. The emulsion was then placed in a 50° C thermostatic bath for 1 hour to ripen the emulsion, wherein sulfur sensitization was achieved.

Further, 50 ml portions of the emulsion were measured out, to each of which a methanol solution of one merocyanine dye free of acidic groups represented by the following structural formulae I-1, I-2, I-3 or I-4:

Dye I-1

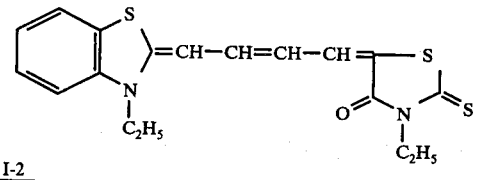

Dye I-2

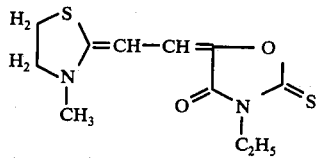

Dye I-3

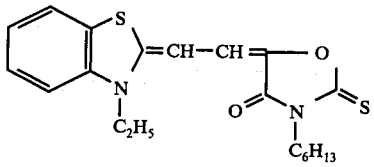

Dye I-4

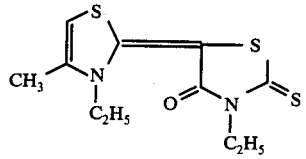

was added, followed by the addition of a methanol solution of benzotriazole compound II-1 (described hereinbefore). Each of the resulting emulsion portions was coated on a transparent cellulose acetate film support having a gelatin subbing layer thereon in a dry thickness of about 4 microns and then dried. Thus, samples of photographic light-sensitive materials were obtained.

Each of these film samples was continuously wedgewise exposed using as a light source a tungsten lamp of a color temperature of 2854° K covered with a blue filter or a minus blue filter. The exposure time was 10 seconds in all cases. A gelatin filter made by Fuji Photo Film Co., Ltd. (which transmits light in the wavelength region of about 400 nm to 500 nm, and has a maximum transmittance of 40% at 450 nm) was used as a blue filter, while a colored glass filter VO52 made by Tokyo Shibaura Electric Co., Ltd. (which transmits light of wavelengths longer than about 490 nm, for example, which transmits about 10% at 500 nm, about 73% at 520 nm, and 80 to 90% at wavelengths longer than 540 nm) was employed as a minus blue filter.

The thus exposed samples were development-processed at 20° C for 10 minutes using a metol-ascorbic acid developing solution. The metol-ascorbic acid developing solution contained 25 g of metol, 10 g of ascorbic acid, 1.0 g of potassium bromide, 35.0 g of Nabox and water in such an amount as to make the total volume of the solution 1 liter (the pH of which was adjusted to 9.8). The density of the images was measured using an automatic densitometer made by Fuji Photo Film Co., Ltd. The photographic sensitivity was expressed as the reciprocal of the amount of exposure required for providing an optical density of fog + 0.1. The minus blue sensitivity is a relative sensitivity determined by using a minus blue filter. The results obtained as shown in Table 1 below.

TABLE 1

| Run No. | Dye | Amount Used (milli-mol/ mol of AgBr) | Compound II-1 (milli-mol/ mol of AgBr) | Minus $S_B$* | $S_B$* |
|---|---|---|---|---|---|
| 1 | I-1 | 0 | 0 | — | 100 (standard) |
| | I-1 | 0 | 0.67 | — | 96 |
| | I-1 | 0 | 2.67 | — | 96 |
| | I-1 | 0 | 10.7 | — | 87 |
| | I-1 | 0.058 | 0 | 100 (standard) | — |
| | I-1 | 0.116 | 0 | 89 | — |
| 2 | I-1 | 0.058 | 0.67 | 129 | — |
| | I-1 | 0.116 | 0.67 | 87 | |
| 3 | I-1 | 0.058 | 2.67 | 170 | |
| | I-1 | 0.116 | 2.67 | 151 | |
| 4 | I-1 | 0.058 | 10.7 | 380 | |
| | I-1 | 0.116 | 10.7 | 302 | |
| 5 | I-2 | 0.058 | 0 | 57 | |
| | I-2 | 0.116 | 0 | 72 | |
| | I-2 | 0.232 | 0 | 100 (standard) | |
| 6 | I-2 | 0.058 | 0.67 | 93 | |
| | I-2 | 0.116 | 0.67 | 115 | |
| | I-2 | 0.232 | 0.67 | 105 | |
| 7 | I-2 | 0.058 | 2.67 | 148 | |
| | I-2 | 0.116 | 2.67 | 151 | |
| | I-2 | 0.232 | 2.67 | 159 | |
| 8 | I-2 | 0.058 | 10.7 | 132 | |
| | I-2 | 0.116 | 10.7 | 200 | |
| | I-2 | 0.232 | 10.7 | 166 | |
| 9 | I-3 | 0.116 | 0 | 58 | |
| | I-3 | 0.232 | 0 | 100 (standard) | |
| 10 | I-3 | 0.116 | 0.67 | 115 | |
| | I-3 | 0.232 | 0.67 | 132 | |
| 11 | I-3 | 0.116 | 2.67 | 145 | |
| | I-3 | 0.232 | 2.67 | 174 | |
| 12 | I-3 | 0.116 | 10.7 | 141 | |
| | I-3 | 0.232 | 10.7 | 145 | |
| 13 | I-4 | 0.116 | 0 | 50 | |
| | I-4 | 0.232 | 0 | 100 (standard) | |
| 14 | I-4 | 0.116 | 10.7 | 100 | |
| | I-4 | 0.232 | 10.7 | 276 | |

$S_B$*: Relative value of the blue filter sensitivity.

It can be clearly understood from the results in Table 1 that the minus blue sensitivity of the emulsion containing cubic silver bromide grains measuring 1.0 micron in size, which was subjected to sulfur sensitization and dye sensitization with a merocyanine dye free of acidic groups, I-1, I-2, I-3 or I-4, can be markedly increased by the addition of the benzotriazole compound II-1.

COMPARISON EXAMPLE 1

50 ml portions of an emulsion containing cubic silver bromide grains measuring 1.0 micron in size which had been sulfur sensitized, which was prepared in the same manner as in Example 1, were measured out, to each of which a methanol solution of the acidic group-containing merocyanine dye having the following formulae I-a, I-b, I-c or I-d:

Dye I-a

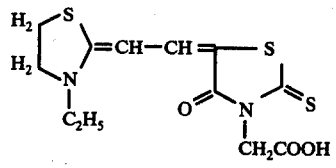

Dye I-b

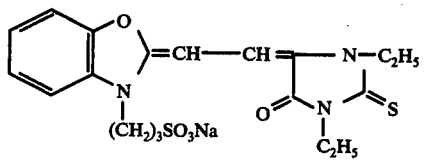

Dye I-c

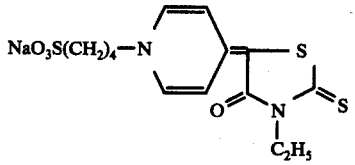

Dye I-d

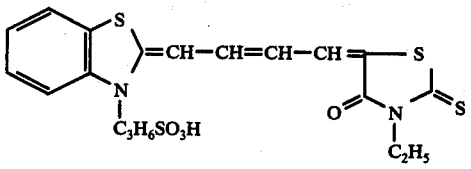

and a methanol solution of benzotriazole Compound II-1 were added. The thus finished emulsion portions each was coated on a transparent film support made of cellulose acetate on which a gelatin subbing layer had been provided in a dry thickness of about 4 microns. Thus, samples of photographic light-sensitive materials were prepared.

Each of the above-described samples was evaluated under the same conditions as in Example 1. The values of the sensitivity obtained were shown in Table 2.

TABLE 2

| Run No. | Dye | Amount Used (milli-mol/ mol of AgBr) | Compound II-1 milli-mol/ mol of AgBr) | Minus Blue* Sensitivity |
|---|---|---|---|---|
| 15 | I-a | 0.058 | 0 | 100 (standard) |
| | I-a | 0.116 | 0 | 95 |
| 16 | I-a | 0.058 | 0.67 | 102 |
| | I-a | 0.116 | 0.67 | 102 |
| 17 | I-a | 0.058 | 2.67 | 120 |
| | I-a | 0.116 | 2.67 | 120 |
| 18 | I-a | 0.058 | 10.7 | 89 |
| | I-a | 0.116 | 10.7 | 115 |
| 19 | I-b | 0.058 | 0 | 50 |
| | I-b | 0.116 | 0 | 100 (standard) |
| | I-b | 0.232 | 0 | 83 |
| 20 | I-b | 0.058 | 0.67 | 56 |
| | I-b | 0.116 | 0.67 | 96 |
| | I-b | 0.232 | 0.67 | 85 |
| 21 | I-b | 0.058 | 2.67 | 69 |
| | I-b | 0.116 | 2.67 | 83 |
| | I-b | 0.232 | 2.67 | 83 |
| 22 | I-b | 0.058 | 10.7 | 39 |
| | I-b | 0.116 | 10.7 | 59 |
| | I-b | 0.232 | 10.7 | 76 |
| 23 | I-c | 0.116 | 0 | 55 |
| | I-c | 0.232 | 0 | 100 (standard) |
| 24 | I-c | 0.116 | 0.67 | 59 |
| | I-c | 0.232 | 0.67 | 105 |
| 25 | I-c | 0.116 | 2.67 | 59 |
| | I-c | 0.232 | 2.67 | 95 |

TABLE 2-continued

| Run No. | Dye | Amount Used (milli-mol/ mol of AgBr) | Compound II-1 milli-mol/ mol of AgBr) | Minus Blue* Sensitivity |
|---|---|---|---|---|
| 26 | I-c | 0.116 | 10.7 | 52 |
| | I-c | 0.232 | 10.7 | 110 |
| 27 | I-d | 0.058 | 0 | 100 (standard) |
| | I-d | 0.116 | 0 | 66 |
| | I-d | 0.232 | 0 | 46 |
| 28 | I-d | 0.058 | 0.67 | 78 |
| | I-d | 0.116 | 0.67 | 52 |
| | I-d | 0.232 | 0.67 | 40 |
| 29 | I-d | 0.058 | 2.67 | 98 |
| | I-d | 0.116 | 2.67 | 44 |
| | I-d | 0.232 | 2.67 | 25 |

*Relative value

It is apparent from the above-described values of sensitivity in Table 2 that the minus blue sensitivity of the emulsion containing cubic silver bromide grains measuring 1.0 micron in size, which was subjected to sulfur sensitization and dye sensitization with the acidic group-containing merocyanine dye having the formula I-a, I-b, I-c or I-d, was not markedly increased by the addition of the benzotriazole compound II-1.

EXAMPLE 2

A photographic emulsion containing silver bromide grains which had an octahedral crystal structure and an average grain size of 0.7 micron was produced using a conventional double run method. The emulsion contained 0.38 mol of silver bromide and about 45 g of gelatin per liter thereof. A 6 liter portion of the thus obtained emulsion was measured out, to which 24 ml of a 0.1% by weight aqueous solution of sodium thiosulfate (pentahydrate) was added. The emulsion was then placed in a 50° C thermostatic bath for one hour to ripen the emulsion, wherein sulfur sensitization was achieved.

Furthermore, 50 ml portions of the emulsion were measured out, to each of which a methanol solution of one merocyanine dye free of acidic groups represented by the structural formulae I-1, I-2 or I-3 described hereinbefore, and a methanol solution of benzotriazole compound II-1 or II-2 were added. Each of the resulting emulsion portions was coated on a transparent cellulose acetate film support having a gelatin subbing layer thereon in a dry thickness of about 4 microns and then dried. Thus, samples of photographic light-sensitive materials were obtained.

The above-described samples were examined under the same conditions as in Example 1. The values of sensitivity obtained are shown in Table 3.

TABLE 3

| Run No. | Dye | Amount Used (milli-mol/ mol of AgBr) | Compound | Amount Used (milli-mol/ mol of AgBr) | Minus Blue* Sensitivity |
|---|---|---|---|---|---|
| 30 | I-1 | 0.058 | II-1 | 0 | 100 (standard) |
| | I-1 | 0.116 | II-1 | 0 | 98 |
| | I-1 | 0.232 | II-1 | 0 | 83 |
| 31 | I-1 | 0.058 | II-1 | 0.67 | 174 |
| | I-1 | 0.116 | II-1 | 0.67 | 209 |
| | I-1 | 0.232 | II-1 | 0.67 | 224 |
| 32 | I-1 | 0.058 | II-1 | 2.67 | 167 |
| | I-1 | 0.116 | II-1 | 2.67 | 229 |
| | I-1 | 0.232 | II-1 | 2.67 | 302 |
| 33 | I-1 | 0.058 | II-1 | 10.7 | 200 |
| | I-1 | 0.116 | II-1 | 10.7 | 339 |
| | I-1 | 0.232 | II-1 | 10.7 | 457 |
| 34 | I-1 | 0.058 | II-2 | 0 | 66 |
| | I-1 | 0.116 | II-2 | 0 | 72 |
| | I-1 | 0.232 | II-2 | 0 | 100 |

TABLE 3-continued

| Run No. | Dye | Amount Used (milli-mol/ mol of AgBr) | Compound | Amount Used (milli-mol/ mol of AgBr) | Minus Blue* Sensitivity |
|---|---|---|---|---|---|
| | | | | | (standard) |
| 35 | I-1 | 0.058 | II-2 | 0.67 | 102 |
| | I-1 | 0.116 | II-2 | 0.67 | 214 |
| | I-1 | 0.232 | II-2 | 0.67 | 316 |
| 36 | I-1 | 0.058 | II-2 | 2.67 | 85 |
| | I-1 | 0.116 | II-2 | 2.67 | 159 |
| | I-1 | 0.232 | II-2 | 2.67 | 288 |
| 37 | I-1 | 0.058 | II-2 | 10.7 | 118 |
| | I-1 | 0.116 | II-2 | 10.7 | 246 |
| | I-1 | 0.232 | II-2 | 10.7 | 490 |
| 38 | I-2 | 0.058 | II-2 | 0 | 41 |
| | I-2 | 0.116 | II-2 | 0 | 55 |
| | I-2 | 0.232 | II-2 | 0 | 100 |
| | | | | | (standard) |
| 39 | I-2 | 0.058 | II-2 | 0.67 | 141 |
| | I-2 | 0.116 | II-2 | 0.67 | 212 |
| | I-2 | 0.232 | II-2 | 0.67 | 309 |
| 40 | I-2 | 0.058 | II-2 | 2.67 | 159 |
| | I-2 | 0.116 | II-2 | 2.67 | 276 |
| | I-2 | 0.232 | II-2 | 2.67 | 324 |
| 41 | I-2 | 0.058 | II-2 | 10.7 | 191 |
| | I-2 | 0.116 | II-2 | 10.7 | 234 |
| | I-2 | 0.232 | II-2 | 10.7 | 270 |
| 42 | I-3 | 0.116 | II-1 | 0 | 69 |
| | I-3 | 0.232 | II-1 | 0 | 100 |
| | | | | | (standard) |
| 43 | I-3 | 0.116 | II-1 | 0.67 | 98 |
| | I-3 | 0.232 | II-1 | 0.67 | 112 |
| 44 | I-3 | 0.116 | II-1 | 2.67 | 155 |
| | I-3 | 0.232 | II-1 | 2.67 | 170 |
| 45 | I-3 | 0.116 | II-1 | 10.7 | 141 |
| | I-3 | 0.232 | II-1 | 10.7 | 159 |

*Relative value

It can be clearly understood from the sensitivity values shown in Table 3 above that the minus blue sensitivity of the emulsion containing octahedral silver bromide grains measuring 0.7 micron in size, which was subjected to sulfur sensitization and dye sensitization with a merocyanine dye free of acidic groups, can be markedly increased by each of addition of benzotriazole compounds II-1 and II-2.

COMPARISON EXAMPLE 2

A photographic emulsion containing octahedral silver bromide grains measuring 0.7 micron in size was prepared using a conventional double run method. The emulsion contained 0.38 mol of silver bromide and about 45 g of gelatin per liter thereof. A 2 liter portion of the thus obtained emulsion was measured out, to which 5 ml of a 0.1% by weight aqueous solution of sodium thiosulfate (pentahydrate) was added. The emulsion was then placed in a 50° C thermostatic bath for one hour to ripen the emulsion, wherein sulfur sensitization was achieved.

Furthermore, 50 ml portions of the emulsion were measured out, to each of which a methanol solution of an acidic group-containing merocyanine described hereinbefore and a methanol solution of benzotriazole compound II-1 were added. Each of the resulting emulsion portions was coated on a transparent cellulose acetate film support having a gelatin subbing layer thereon in a dry thickness of about 4 microns and then dried. Thus, samples of photographic light-sensitive materials were obtained.

The above-described samples were evaluated under the same conditions as in Example 1. The results obtained are shown in Table 4 below.

TABLE 4

| Run No. | Dye | Amount Used (milli-mol/ mol of AgBr) | Compound II-1 (milli-mol/ mol of AgBr) | Minus Blue* Sensitivity |
|---|---|---|---|---|
| 46 | I-a | 0.058 | 0 | 45 |
| | I-a | 0.116 | 0 | 45 |
| | I-a | 0.232 | 0 | 100 |
| | | | | (standard) |
| 47 | I-a | 0.058 | 0.67 | 36 |
| | I-a | 0.116 | 0.67 | 45 |
| | I-a | 0.232 | 0.67 | 85 |
| 48 | I-a | 0.058 | 2.67 | 54 |
| | I-a | 0.116 | 2.67 | 51 |
| | I-a | 0.232 | 2.67 | 85 |
| 49 | I-a | 0.058 | 10.7 | 39 |
| | I-a | 0.116 | 10.7 | 42 |
| | I-a | 0.232 | 10.7 | 35 |
| 50 | I-c | 0.232 | 0 | 100 |
| | | | | (standard) |
| 51 | I-c | 0.232 | 0.67 | 83 |
| 52 | I-C | 0.232 | 2.67 | 93 |
| 53 | I-c | 0.232 | 10.7 | 74 |

*Relative value

It is apparent from the sensitivity values in Table 4 above that the minus blue sensitivity of the emulsion containing octahedral silver bromide grains measuring 0.7 micron in size, which was subjected to sulfur sensitization and dye sensitization with an acidic group-containing merocyanine dye I-a or I-c was not increased by the addition of the benzotriazole compound II-1.

EXAMPLE 3

A photographic emulsion containing silver bromide grains which have a cubic crystal structure and an average grain size of 1 micron was produced using a conventional double run method. The emulsion contained 0.38 mol of silver bromide and about 45 g of gelatin per liter thereof. Without chemically sensitizing the emulsion, 50 ml portions of the emulsion were measured out, to each of which a methanol solution of a merocyanine dye free of acidic groups represented by the structural formula I-1 was added, followed by the addition of benzotriazole compound II-1. Each of the resulting emulsion portions was coated on a transparent cellulose acetate film support having a gelatin subbing layer thereon in a dry thickness of about 4 microns and then dried. Thus, samples of photographic light-sensitive materials were obtained.

All of the above-described samples were evaluated under the same conditions as in Example 1. The results obtained are shown in Table 5.

TABLE 5

| Run No. | Dye I-1 (milli-mol/ mol of AgBr) | Compound II-1 (milli-mol/ mol of AgBr) | Minus Blue* Sensitivity |
|---|---|---|---|
| 54 | 0.232 | 0 | 100 |
| | | | (standard) |
| 55 | 0.232 | 0.67 | 123 |
| 56 | 0.232 | 2.67 | 195 |
| 57 | 0.232 | 10.7 | 214 |

*Relative value

It can be clearly understood from a comparison of the results obtained in Table 1 with the results shown in Table 5 that the minus blue sensitivity of the emulsion containing cubic silver bromide grains measuring 1.0 micron in size, which was subjected to dye sensitization with a merocyanine dye free of acidic groups, I-1, can be markedly increased independently of chemical sensitization, by the addition of the benzotriazole compound II-1.

EXAMPLE 4

50 ml portions of an emulsion chemically sensitized with sulfur compounds the same as in Example 1, which contained cubic silver bromide grains measuring 1.0 micron in size, were measured out, to each of which a methanol solution of the merocyanine dye free of acidic groups, I-1 or I-2, was added and stirred for 20 minutes. Then, a methanol solution of benzotriazole compound II-1 was added to each of the emulsion portions. Each of the resulting emulsion portions was coated on a transparent cellulose acetate film support having a gelatin subbing layer thereon in a dry thickness of about 4 microns and then dried. Thus, samples of photographic light-sensitive materials were obtained. These samples were designated Film A. On the other hand, other 50 ml portions of the emulsion chemically sensitized with a sulfur compound, which contained cubic silver bromide grains measuring 1.0 micron in size, the same as in Example 1 were measured, to each of which a methanol solution of benzotriazole compound II-1 was added, and stirred for 10 minutes. A method solution of merocyanine dye I-1 or I-2 was added to each of the resulting emulsion portions, which was additionally stirred for 20 minutes. Then, samples of photographic light-sensitive materials were prepared the same as the above-described examples. These samples were designated Film B.

The above-described Films A and B were evaluated under the same conditions as in Example 1. The results obtained are shown in Table 6.

TABLE 6

| Run No. | Film | Dye | Amount Used (milli-mol/ mol of AgBr) | Compound II-1 (milli-mol/ mol of AgBr) | Minus Blue* Sensitivity |
|---|---|---|---|---|---|
| 58 | A | I-1 | 0.116 | 0 | 100 (standard) |
| | A | I-1 | 0.232 | 0 | 98 |
| 59 | A | I-1 | 0.116 | 0.67 | 167 |
| | A | I-1 | 0.232 | 0.67 | 234 |
| 60 | A | I-1 | 0.116 | 2.67 | 191 |
| | A | I-1 | 0.232 | 2.67 | 282 |
| 61 | A | I-1 | 0.116 | 10.7 | 195 |
| | A | I:1 | 0.232 | 10.7 | 234 |
| 62 | A | I-2 | 0.058 | 0 | 68 |
| | A | I-2 | 0.116 | 0 | 93 |
| | A | I-2 | 0.232 | 0 | 100 (standard) |
| 63 | A | I-2 | 0.058 | 0.67 | 159 |
| | A | I-2 | 0.116 | 0.67 | 219 |
| | A | I-2 | 0.232 | 0.67 | 209 |
| 64 | A | I-2 | 0.058 | 2.67 | 155 |
| | A | I-2 | 0.116 | 2.67 | 186 |
| | A | I-2 | 0.232 | 2.67 | 155 |
| 65 | A | I-2 | 0.058 | 10.7 | 166 |
| | A | I-2 | 0.116 | 10.7 | 170 |
| | A | I-2 | 0.232 | 10.7 | 209 |
| 66 | B | I-1 | 0.116 | 0 | 100 (standard) |
| | B | I-1 | 0.232 | 0 | 89 |
| 67 | B | I-1 | 0.116 | 0.67 | 230 |
| | B | I-1 | 0.232 | 0.67 | 257 |
| 68 | B | I-1 | 0.116 | 2.67 | 257 |
| | B | I-1 | 0.232 | 2.67 | 398 |
| 69 | B | I-1 | 0.116 | 10.7 | 209 |
| | B | I-1 | 0.232 | 10.7 | 316 |
| 70 | B | I-2 | 0.058 | 0 | 74 |
| | B | I-2 | 0.116 | 0 | 93 |
| | B | I-2 | 0.232 | 0 | 100 (standard) |
| 71 | B | I-2 | 0.058 | 0.67 | 135 |
| | B | I-2 | 0.116 | 0.67 | 209 |
| | B | I-2 | 0.232 | 0.67 | 204 |
| 72 | B | I-2 | 0.058 | 2.67 | 123 |

TABLE 6-continued

| Run No. | Film | Dye | Amount Used (milli-mol/ mol of AgBr) | Compound II-1 (milli-mol/ mol of AgBr) | Minus Blue* Sensitivity |
|---|---|---|---|---|---|
| | B | I-2 | 0.116 | 2.67 | 135 |
| | B | I-2 | 0.232 | 2.67 | 115 |
| 73 | B | I-2 | 0.058 | 10.7 | 138 |
| | B | I-2 | 0.116 | 10.7 | 162 |
| | B | I-2 | 0.232 | 10.7 | 151 |

*Relative value

It can be understood from the sensitivity values shown in Table 6 that the minus blue sensitivity of the silver bromide emulsion containing cubic grains measuring 1.0 micron in size, which was subjected to dye sensitization with merocyanine dye I-1 or I-2 free of acidic groups can be markedly increased independently of the order of addition adopted when the merocyanine dye and the benzotriazole compound are added to the chemically sensitized emulsion, by the addition of the benzotriazole compound II-1.

EXAMPLE 5

Photographic emulsions containing three different kinds of cubic silver iodobromide grains were produced using a conventional double run method. The average grain sizes of three different kinds of grains (designated a, b and c) were 0.6, 0.5 and 0.4 micron, respectively, and the silver iodide contents were 0.25, 1 and 4 mol %, respectively. A water solution of silver nitrate and a water solution of a mixture of potassium bromide and potassium iodide were added simultaneously to a gelatin aqueous solution with thorough stirring in such a manner that the silver ion concentration in the gelatin solution was kept at a constant value. The thus prepared emulsion contained 0.38 mol of silver bromide and about 45 g of gelatin per liter thereof.

A 2 liter portion of each of the thus obtained emulsions was measured out, to which 56 ml of a 0.1% by weight aqueous solution of sodium thiosulfate (pentahydrate) was added. The emulsion was then placed in a 50° C thermostatic bath for one hour to ripen the emulsion, wherein sulfur sensitization was achieved.

Further, 50 ml portions of each of the emulsions were measured out, to each of which a methanol solution of a merocyanine dye free of acidic groups, I-1 or I-2, was added, followed by the addition of a methanol solution of the benzotriazole compound II-1. Each of the resulting emulsion portions was coated on a transparent cellulose acetate film support having a gelatin subbing layer thereon in a dry thickness of about 4 microns. Thus, samples of photographic light-sensitive materials were obtained.

The above-described samples were evaluated under the same conditions as in Example 1, and the results obtained are shown in Table 7.

TABLE 7

| Run No. | Type of Grain | Dye | Amount Used (milli-mol/ mol of AgBr) | Compound II-1 (milli-mol/ mol of AgBr) | Minus Blue* Sensitivity |
|---|---|---|---|---|---|
| 74 | a | I-1 | 0.116 | 0 | 74 |
| | a | I-1 | 0.232 | 0 | 100 (standard) |
| 75 | a | I-1 | 0.116 | 0.67 | 126 |
| | a | I-1 | 0.232 | 0.67 | 138 |
| 76 | a | I-1 | 0.116 | 2.67 | 96 |
| | a | I-1 | 0.232 | 2.67 | 170 |
| 77 | a | I-1 | 0.116 | 10.7 | 79 |
| | a | I-1 | 0.232 | 10.7 | 186 |

TABLE 7-continued

| Run No. | Type of Grain | Dye | Amount Used (milli-mol/ mol of AgBr) | Compound II-1 (milli-mol/ mol of AgBr) | Minus Blue* Sensitivity |
|---|---|---|---|---|---|
| 78 | a | I-2 | 0.116 | 0 | 100 (standard) |
| | a | I-2 | 0.232 | 0 | 81 |
| 79 | a | I-2 | 0.116 | 0.67 | 123 |
| | a | I-2 | 0.232 | 0.67 | 162 |
| 80 | a | I-2 | 0.116 | 2.67 | 126 |
| | a | I-2 | 0.232 | 2.67 | 107 |
| 81 | b | I-1 | 0.232 | 0 | 100 (standard) |
| 82 | b | I-1 | 0.232 | 0.67 | 132 |
| 83 | b | I-1 | 0.232 | 2.67 | 162 |
| 84 | b | I-1 | 0.232 | 10.7 | 182 |
| 85 | c | I-1 | 0.232 | 0 | 100 (standard) |
| 86 | c | I-1 | 0.232 | 0.67 | 132 |
| 87 | c | I-1 | 0.232 | 2.67 | 112 |
| 88 | c | I-1 | 0.232 | 10.7 | 115 |

*Relative value

It is apparent from the sensitivity values shown in Table 7 that the minus blue sensitivity of the silver iodobromide emulsion containing cubic grains, which was subjected to chemical sensitization with a sulfur compound and dye sensitization with a merocyanine dye free of acidic groups, I-1 or I-2, can be markedly increased by the addition of the benzotriazole compound II-1.

EXAMPLE 6

50 ml portions of a sulfur-sensitized silver bromide emulsion containing cubic grains measuring 1.0 micron in size, which had been prepared in Example 1, were measured out, to each of which a methanol solution of a merocyanine dye free of acidic groups, I-1, I-2 or I-5 (the structural formula of which is described hereinafter) was added, followed by the addition of a methanol solution of the benzotriazole compound II-1 or II-3.

Dye I-5

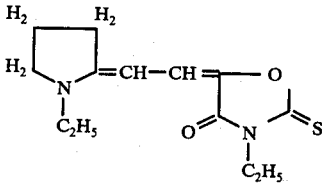

Each of emulsion portions obtained was coated on a transparent cellulose acetate film support having a gelatin subbing layer thereon in a dry thickness of about 4 microns. Thus, samples of photographic light-sensitive materials were obtained.

The above-described samples were evaluated under the same conditions as in Example 1, and the results obtained are shown in Table 8.

TABLE 8

| Run No. | Dye | Amount Used (milli-mol/ mol of AgBr) | Compound | Amount Used (milli-mol/ mol of AgBr) | Minus Blue* Sensitivity |
|---|---|---|---|---|---|
| 89 | I-2 | 0.058 | II-3 | 0 | 63 |
| | I-2 | 0.116 | II-3 | 0 | 80 |
| | I-2 | 0.232 | II-3 | 0 | 100 (standard) |
| 90 | I-2 | 0.058 | II-3 | 0.67 | 72 |
| | I-2 | 0.116 | II-3 | 0.67 | 112 |
| | I-2 | 0.232 | II-3 | 0.67 | 138 |
| 91 | I-2 | 0.058 | II-3 | 2.67 | 123 |
| | I-2 | 0.116 | II-3 | 2.67 | 145 |
| | I-2 | 0.232 | II-3 | 2.67 | 115 |
| 92 | I-2 | 0.232 | II-3 | 10.7 | 152 |
| 93 | I-1 | 0.116 | II-3 | 0 | 100 (standard) |
| | I-1 | 0.232 | II-3 | 0 | 100 |
| 94 | I-1 | 0.116 | II-3 | 2.67 | 145 |
| | I-1 | 0.232 | II-3 | 2.67 | 178 |
| 95 | I-1 | 0.116 | II-3 | 10.7 | 100 |
| | I-1 | 0.232 | II-3 | 10.7 | 182 |
| 96 | I-5 | 0.058 | II-1 | 0 | 47 |
| | I-5 | 0.116 | II-1 | 0 | 59 |
| | I-5 | 0.232 | II-1 | 0 | 100 (standard) |
| 97 | I-5 | 0.058 | II-1 | 0.67 | 83 |
| | I-5 | 0.116 | II-1 | 0.67 | 118 |
| | I-5 | 0.232 | II-1 | 0.67 | 112 |
| 98 | I-5 | 0.058 | II-1 | 2.67 | 132 |
| | I-5 | 0.116 | II-1 | 2.67 | 152 |
| | I-5 | 0.232 | II-1 | 2.67 | 204 |
| 99 | I-5 | 0.058 | II-1 | 10.7 | 93 |
| | I-5 | 0.116 | II-1 | 10.7 | 132 |
| | I-5 | 0.232 | II-1 | 10.7 | 155 |

*Relative value

It is apparent from the above-described sensitivity values in Table 8 that the minus blue sensitivity of a silver bromide emulsion containing cubic grains measuring 1.0 micron in size, which was sulfur sensitized, and then subjected to dye sensitization with a merocyanine dye free of acidic groups, I-1, I-2 or I-5, can be remarkably increased by the addition of the benzotriazole compound II-1 or II-3.

EXAMPLE 7

50 ml portions of a sulfur-sensitized silver bromide emulsion containing cubic grains measuring 1.0 micron in size, which was prepared the same as in Example 1, were measured out, to each of which a methanol solution of a merocyanine dye free of acidic groups, I-1, I-2 or I-4, was added, followed by the addition of a methanol solution of the benzotriazole compound II-1. Each of the finished emulsions was coated on a transparent cellulose acetate film support having a gelatin subbing layer thereon in a dry thickness of about 4 microns. Thus, samples of photographic light-sensitive materials were obtained.

Each of the samples was exposed to light from a xenon flash lamp through a continuous wedge and a minus blue filter for 10 seconds. A yellow filter made by Fuji Photo Film Co., Ltd. (which transmits light having longer wavelengths than about 490 nm, for example, which transmits about 25% at 500 nm, about 60% at 550 nm, about 75% at 600 nm and about 85% at 700 nm) was employed as a minus blue filter. The exposed films were evaluated the same as in Example 1. The sensitivity values obtained are shown in Table 9. The minus blue sensitivity was the relative sensitivity determined by using the above-described minus blue filter.

TABLE 9

| Run No. | Dye | Amount Used (milli-mol/ (mol of AgBr) | Compound II-1 (milli-mol/ mol of AgBr) | Minus Blue* Sensitivity |
|---|---|---|---|---|
| 100 | I-1 | 0.058 | 0 | 100 (standard) |
| | I-1 | 0.116 | 0 | 85 |
| 101 | I-1 | 0.058 | 10.7 | 224 |
| | I-1 | 0.116 | 10.7 | 141 |
| 102 | I-2 | 0.116 | 0 | 55 |
| | I-2 | 0.232 | 0 | 100 |

TABLE 9-continued

| Run No. | Dye | Amount Used (milli-mol/ (mol of AgBr) | Compound II-1 (milli-mol/ mol of AgBr) | Minus Blue* Sensitivity |
|---|---|---|---|---|
| | | | | (standard) |
| 103 | I-2 | 0.116 | 2.67 | 129 |
| | I-2 | 0.232 | 2.67 | 159 |
| 104 | I-4 | 0.232 | 0 | 100 (standard) |
| 105 | I-4 | 0.232 | 0.67 | 121 |
| 106 | I-4 | 0.232 | 2.67 | 138 |
| 107 | I-4 | 0.232 | 10.7 | 195 |

*Relative value

It is apparent from the above-described sensitivity values in Table 9 that the minus blue sensitivity of the silver bromide emulsion containing cubic grains measuring 1.0 micron in size, which was subjected to sulfur sensitization and dye sensitization with a merocyanine dye free of acidic groups, I-1, I-2 or I-4, is remarkably increased by the addition o the benzotriazole compound II-1 even when the emulsion was exposed for a short period of time.

EXAMPLE 8

A photographic emulsion containing cubic silver chloride grains measuring 0.3 micron on the average was produced using a conventional double run method. More specifically, a water solution of silver nitrate and a water solution of sodium chloride were added simultaneously to a gelatin aqueous solution with thorough stirring. About 0.3 mol of silver chloride and about 45 g of gelatin were contained in the resulting emulsion per liter.

A 2 liter portion of the thus prepared emulsion was measured out, to which 13.3 ml of a 0.1% by weight solution of sodium thiosulfate (pentahydrate) was added. The emulsion was then placed in a 50° C thermostatic bath for 1 hour to ripen the emulsion, wherein sulfur sensitization was achieved.

Furthermore, 50 ml portions of the emulsion were measured out, to each of which a methanol solution of a merocyanine dye free of acidic groups, I-1 or I-2, was added, followed by the addition of a methanol solution of the benzotriazole compound II-1. Each of the resulting emulsion portions was coated on a transparent cellulose acetate film support having a gelatin subbing layer thereon in a dry thickness of about 4 microns. Thus, samples of photographic light-sensitive materials were obtained. Each of these samples was evaluated the same as in Example 1. The results obtained are shown in Table 10.

TABLE 10

| Run No. | Dye | Amount Used (milli mol/ mol of AgCl) | Compound II-1 (milli mol/ mol of AgCl) | Minus Blue* Sensitivity |
|---|---|---|---|---|
| 108 | I-1 | 0.295 | 0 | 100 (standard) |
| 109 | I-1 | 0.295 | 0.85 | 110 |
| 110 | I-1 | 0.295 | 3.39 | 214 |
| 111 | I-2 | 0.295 | 0 | 100 (standard) |
| 112 | I-2 | 0.295 | 0.85 | 126 |
| 113 | I-2 | 0.295 | 3.39 | 178 |

*Relative value

It is apparent from the sensitivity values in the above-described Table 10 that the minus blue sensitivity of the silver chloride emulsion containing cubic grains measuring 0.3 micron in size, which was subjected to sulfur sensitization and dye sensitization with a merocyanine dye free of acidic groups, I-1 or I-2, can be markedly increased by the addition of the benzotriazole compound II-1.

While the invention has been described in detail and with reference to specific embodiments thereof, it will be apparent to one skilled in the art that various changes and modifications can be made therein without departing from the spirit and scope thereof.

What is claimed is:

1. A supersenzitized silver halide photographic emulsion which contains, in supersensitizing amounts, a combination of (1) at least one merocyanine dye free of acidic groups and (2) at least one benzotriazole compound which can produce a slightly soluble silver salt by reaction with silver ion, where the solubility product of the resulting silver salt is smaller than that of silver chloride wherein:

said benzotriazole compound has the following general formula (II):

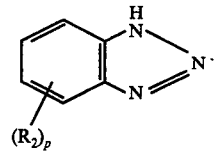

(II)

wherein $p$ represents an integer from 1 to 4; and $R_2$ represents a halogen atom or an alkyl group containing from 1 to 3 carbon atoms;

said merocyanine dye free of acidic groups has the following general formula (I):

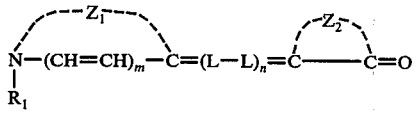

(I)

wherein $m$ represents an integer of 0 or 1; $n$ represents an integer of 0 to 2; $R_1$ represents an aliphatic group or an aryl group; $Z_1$ represents the non-metallic atoms necessary to complete a 5- or 6-membered nitrogen-containing heterocyclic ring; $Z_2$ represents the non-metallic atoms necessary to complete a 5- or 6-membered nitrogen-containing heterocyclic ring; and L represents a methine group; and wherein the amount of said merocyanine dye ranges from about $10^{-6}$ mol to $10^{-2}$ mol per mol of said silver halide and the molar ratio of said benzotriazole compound (2) to said merocyanine dye (1) ranges from about 2:1 to 100:1.

2. The silver halide photographic emulsion of claim 1, wherein said silver halide emulsion is a sulfur sensitized silver halide emulsion.

3. The silver halide photographic emulsion of claim 1, wherein the aliphatic group represented by $R_1$ is an alkyl group having from 1 to 8 carbon atoms, a substituted alkyl group in which the alkyl moiety thereof contains 1 to 4 carbon atoms which can be substituted with a vinyl group, an aryl group, a hydroxy group, an acetoxy group or an alkoxy group, wherein the nitrogen-containing heterocyclic ring represented by $Z_1$ can also contain carbon, nitrogen, oxygen, sulfur and selenium atoms as the non-metallic atoms and wherein the heterocyclic ring can be substituted with one or more of an alkyl group, a monoaryl group, an alkoxy group, a monoaralkyl group, a trifluoromethyl group, a hydroxy group, an alkoxycarbonyl group or a cyano group as substituents or may further include an aliphatic hydrogen residue forming a condensed ring therewith; and said nitrogen-containing heterocyclic ring formed by $Z_2$ can also contain nitrogen, oxygen, sulfur and selenium atoms as the non-metallic atoms and in which the heterocyclic ring formed by $Z_2$ can be substituted with one or more of an alkyl group, an aryl group, an alkoxy group or a monoaralkyl group as a substituent and which may also include an aliphatic hydrocarbon residue forming a condensed ring therewith.

4. The silver halide photographic emulsion of claim 3, wherein said heterocyclic ring formed by $Z_1$ is a thiazole nucleus, a benzothiazole nucleus, a naphthothiazole nucleus, a thiazoline nucleus, an oxazole nucleus, a benzoxazole nucleus, a naphthoxazole nucleus, an oxazoline nucleus, a selenazole nucleus, a benzoselenazole nucleus, a naphthoselenazole nucleus, a 3,3-dialkylindolenine nucleus, an imidazole nucleus, a benzimidazole nucleus, a naphthimidazole nucleus, a tetrazole nucleus, a pyridine nucleus, or a quinoline nucleus and wherein the heterocyclic ring formed by $Z_2$ is an isooxazolone nucleus, a thiobarbituric acid nucleus, a barbituric acid nucleus, a 1,3-indanedione nucleus, a 2-pyrazoline-5-one nucleus, a 2-thiooxazolidinedione nucleus, an oxyindole nucleus, a rhodanine nucleus, or a 2-thiohydantoin nucleus.

5. The silver halide photographic emulsion of claim 1, wherein said merocyanine dye having the general formula (I) has the general formulae (I-A) to (I-F):

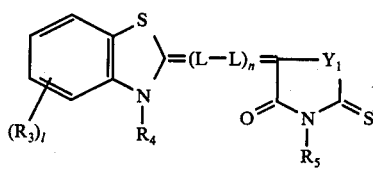

(I-A)

wherein $R_4$ and $R_5$, which may be the same or different, each has the same meaning as $R_1$ in the general formula (I); $R_3$ represents an alkyl group, a monoaryl group, a halogen atom, an alkoxy group, a monoaralkoxy group, a trifluoromethyl group, a hydroxy group, an alkoxycarbonyl group, a cyano group or a saturated or unsaturated aliphatic hydrocarbon residue completing a condensed ring; $Y_1$ represents a sulfur atom or an oxygen atom; $l$ represents an integer of 0 to 4; $n$ represents an integer of from 0 to 2; and L has the same meaning as in the general formula (I);

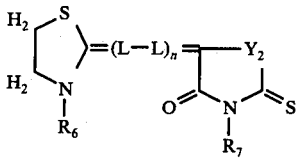

(I-B)

wherein $R_6$ and $R_7$, which may be the same or different, each has the same meaning as $R_1$ in the general formula (I); $Y_2$ represents a sulfur atom or an oxygen atom; L has the same meaning as in the general formula (I); and $n$ represents an integer of from 0 to 2;

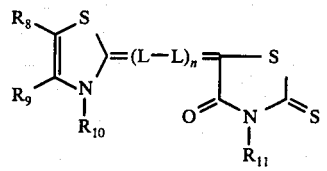

(I-C)

wherein $R_{10}$ and $R_{11}$, which may be the same or different, each has the same meaning as $R_1$ in the general formula (I); $R_8$ and $R_9$, which may be the same or different, each represents an alkyl group or an aryl group; and $n$ and L each has the same meaning as $n$ and L in the general formula (I-A);

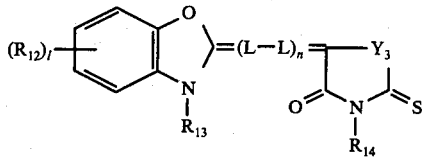

(I-D)

wherein $R_{13}$ and $R_{14}$, which may be the same or different, each has the same meaning as $R_1$ in the general formula (I); $Y_3$ represents a sulfur atom or an $-\underset{|}{N}-T$ group, wherein T has the same meaning as $R_1$ in the general formula (I-A); $l$ and $n$ each has the same meaning as $l$ and $n$ in the general formula (I-A); L has the same meaning as in the general formula (I); and $R_{12}$ represents an alkyl group, a monoaryl group, a halogen atom, a hydroxy group or an alkoxy group;

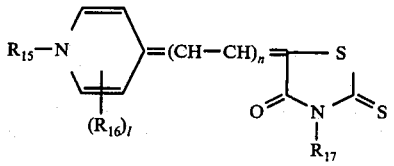

(I-E)

wherein $R_{15}$ and $R_{17}$, which may be the same or different, each has the same meaning as $R_1$ in the general formula (I); $R_{16}$ represents a hydrogen atom or a lower alkyl group; and $l$ and $n$ each has the same meaning as $l$ and $n$ in the general formula (I-A);

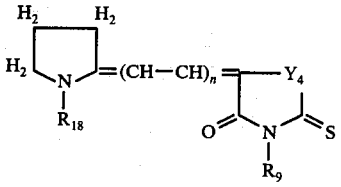

(I-F)

wherein $R_{18}$ and $R_{19}$, which may be the same or different, each has the same meaning as $R_1$ in the general formula (I); $Y_4$ represents an oxygen atom, a sulfur atom or an $$-\underset{|}{N}-T \text{ group,}$$

wherein T has the same meaning as $R_1$ described in the general formula (I) and $n$ has the same meaning as in the general formula (I).

6. The silver halide photographic emulsion of claim 1, wherein said benzotriazole compound is:

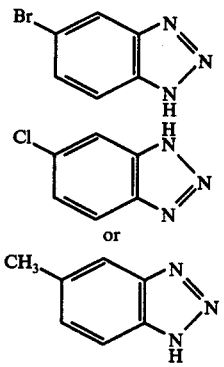

7. The silver halide photographic emulsion of claim 1, wherein L represents a —CH= group or a $-CR_0=$ group, wherein $R_0$ represents a hydrogen atom, an alkyl group, a substituted alkyl group, an aralkyl group, an aryl group or a cycloalkyl group.

8. The silver halide photographic emulsion of claim 1, wherein said benzotriazole is:

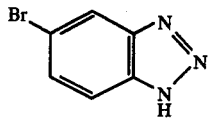

9. The silver halide photographic emulsion of claim 1, wherein said benzotriazole is:

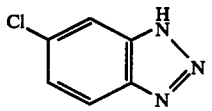

10. The silver halide photographic emulsion of claim 1, wherein said benzotriazole is:

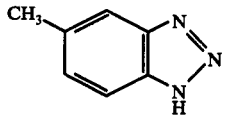

* * * * *